US011187029B1

(12) United States Patent
Van Asten et al.

(10) Patent No.: US 11,187,029 B1
(45) Date of Patent: Nov. 30, 2021

(54) FLEXIBLE DRIP CAP

(71) Applicant: ANDERSEN CORPORATION, Bayport, MN (US)

(72) Inventors: Arik Van Asten, St. Paul, MN (US); Devin Nagel, Oak Park Heights, MN (US); Duane Fier, Hudson, WI (US); Corey Bishman, Cottage Grove, MN (US); Jeremiah Boe, Circle Pines, MN (US)

(73) Assignee: Andersen Corporation, Bayport, MN (US)

( * ) Notice: Subject to any disclaimer, the term of this patent is extended or adjusted under 35 U.S.C. 154(b) by 74 days.

(21) Appl. No.: 16/774,521

(22) Filed: Jan. 28, 2020

Related U.S. Application Data

(60) Provisional application No. 62/799,301, filed on Jan. 31, 2019.

(51) Int. Cl.

| | |
|---|---|
| ***E06B 7/26*** | (2006.01) |
| ***E06B 1/00*** | (2006.01) |
| ***E06B 1/62*** | (2006.01) |

(52) U.S. Cl.
CPC ..... *E06B 7/26* (2013.01); *E06B 1/006* (2013.01); *E06B 1/62* (2013.01); *E06B 2001/622* (2013.01); *E06B 2001/628* (2013.01)

(58) Field of Classification Search
CPC ..... E06B 1/62; E06B 2001/622; E06B 2001/628; E06B 7/26; E06B 1/006
See application file for complete search history.

(56) References Cited

U.S. PATENT DOCUMENTS

| | | | | |
|---|---|---|---|---|
| 4,151,031 | A | 4/1979 | Goad et al. | |
| 4,490,953 | A * | 1/1985 | Meola | E04F 13/06 52/211 |
| 5,735,035 | A | 4/1998 | Holt | |
| 6,047,514 | A | 4/2000 | Verch | |
| 6,244,001 | B1 * | 6/2001 | Anastasi | E06B 1/003 49/504 |
| 6,981,348 | B2 * | 1/2006 | Kjorsvik | E04F 19/02 52/211 |
| 7,797,884 | B2 | 9/2010 | Allen | |
| 8,316,586 | B2 | 11/2012 | Ellingson | |

(Continued)

FOREIGN PATENT DOCUMENTS

| | | | | |
|---|---|---|---|---|
| DE | 2742841 A1 * | 3/1978 | ..... | E04B 1/66 |
| DE | 102015115067 A1 * | 3/2017 | ..... | E06B 1/62 |

OTHER PUBLICATIONS

"Flexible Drip Cap Flashing," B.H. Davis Company, Thompson, CT; Retrieved from the Internet:<URL:http://www.curvedmouldings.com/dripcap.html; retrieved on Sep. 22, 2020: 6 pgs.

(Continued)

*Primary Examiner* — Adriana Figueroa
(74) *Attorney, Agent, or Firm* — Mueting Raasch Group

(57) ABSTRACT

Flexible drip cap for use with fenestration units and related methods. The flexible drip cap includes a flange member and a cap member attached to each other along a length of the drip cap, with a seal member located between the flange member and the cap member. The seal member provides a seal to limit water infiltration between the flange member and the cap member when the drip cap is positioned on a fenestration unit.

25 Claims, 10 Drawing Sheets

(56) References Cited

U.S. PATENT DOCUMENTS

| | | | | |
|---|---|---|---|---|
| 8,347,586 | B2 | 1/2013 | Boldt | |
| 8,561,357 | B2 | 10/2013 | Teodorovich | |
| 8,850,751 | B2 * | 10/2014 | Makin | E04D 13/1478 52/94 |
| 9,426,845 | B2 * | 8/2016 | Hopkins, II | H05B 3/34 |
| 9,909,352 | B2 * | 3/2018 | Norwood | E06B 1/68 |
| 2005/0011140 | A1 * | 1/2005 | Ackerman, Jr. | E06B 1/62 52/58 |

OTHER PUBLICATIONS

"Heavyweight Flexible Drip Cap Flashing," B.H. Davis Company, Thompson, CT; Retrieved from the Internet:<URL:http://www.curvedmouldings.com/dripcap-wo.html; retrieved on Sep. 22, 2020: 12 pgs.

"Medium Weight Flexible Drip Cap Flashing," B.H. Davis Company, Thompson, CT; Retrieved from the Internet:<URL:http://www.curvedmouldings.com/dripcap-ast.html.—retrieved on Sep. 22, 2020: 8 pgs.

* cited by examiner

FLEXIBLE DRIP CAP

RELATED APPLICATION

This application claims the benefit under 35 U.S.C. Section 119 of U.S. Provisional Patent Application Ser. No. 62/799,301 entitled "FLEXIBLE DRIP CAP" and filed on Jan. 31, 2019, which is incorporated herein by reference in its entirety.

Flexible drip cap for use with fenestration units and related methods are described herein.

Fenestration units (such as, e.g., windows, doors, etc.) are typically installed in building openings with features or components located along the top edge of the fenestration unit frame designed to limit or prevent water infiltration along that top edge. In many installations, building codes require drip cap to be positioned along the top edge of a fenestration unit frame, with a generally vertical portion of the drip cap tucked up underneath a barrier plane of the building wall in which the fenestration unit is installed and a generally horizontal portion covering the top edge of the fenestration unit frame to shed water out and away from the fenestration unit.

It is relatively easy to apply drip cap along the top of windows having straight edges. In those situations, straight conventional drip cap can be obtained and applied easily.

Fenestration units having curved top edges and other custom shapes may, however, require contoured drip cap to follow the top edges of the fenestration unit. Such drip cap is not, however, readily available. In some situations, conventional straight drip cap can be bent and/or folded to approximate the shape of the top edge of the fenestration unit. That process can, however, be complex and often results in reduced water shedding performance along with reduced aesthetics Another option for fenestration units having curved top edges and other custom shapes is to use a custom aluminum or polymeric drip cap. This approach often, however, results in relatively large and relatively rigid drip cap that is difficult to transport and handle. In addition, different drip cap must be obtained for fenestration units having curvatures of different radii.

SUMMARY

Flexible drip cap for use with fenestration units and related methods are described herein.

The flexible drip cap described herein includes a flange member and a cap member attached to each other along a length of the drip cap, with a seal member located between the flange member and the cap member. The seal member provides a seal to limit (preferably prevent) water infiltration between the flange member and the cap member when the drip cap is positioned on a fenestration unit.

In one or more embodiments, the flexible drip cap described herein may be easily bent, either elastically or plastically, to adapt to the shape of a variety of fenestration unit frames while maintaining structural integrity required to shed water as needed. The flexible drip cap described herein can adapt to differently shaped fenestration units without requiring custom bending or forming and while maintaining good water shedding performance.

In one or more embodiments, the flexible drip cap described herein can be manufactured and stored in a straight format to simplify manufacturing, transportation, and storage of the flexible drip cap before use on a fenestration unit.

The flexible drip cap described herein may, in one or more embodiments, include a stiffener to provide further improvements in the structural integrity of the drip cap without significantly degrading its ability to be formed in the field to a selected shape of a fenestration unit on which the flexible drip cap is installed.

In a first aspect, one or more embodiments of a flexible drip cap as described herein may include: a spine extending along a length of the flexible drip cap; a cap member comprising a back edge and a front edge, wherein the back edge of the cap member extends along the spine of the flexible drip cap, and wherein the front edge of the cap member is spaced away from the back edge and the spine along the length of the flexible drip cap; and a flange member comprising a base edge and free edge, wherein the base edge of the flange member extends along the spine of the flexible drip cap, and wherein the free edge of the flange member is spaced away from the base edge and the spine along the length of the flexible drip cap; and a seal member comprising an inner edge and an outer edge, wherein the inner edge of the seal member extends along the spine of the flexible drip cap, and wherein the outer edge of the seal member is spaced away from the inner edge and the spine along the length of the flexible drip cap; wherein the back edge of the cap member and the base edge of the flange member are attached to each other proximate the spine of the flexible drip cap such that the cap member and the flange member define an inside corner of the flexible drip cap when the cap member and the flange member are positioned such that the seal member is located within an arc of less than 180 degrees centered along the spine and extending from the cap member to the flange member.

In one or more embodiments of the flexible drip cap described herein, the back edge of the cap member and the base edge of the flange member are attached to each other along a junction, and wherein the spine of the flexible drip cap comprises the junction of the back edge and the base edge. In one or more embodiments, the inner edge of the seal member is attached to the cap member proximate the back edge of the cap member, the flange member proximate the base edge of the flange member, or the cap member proximate the back edge of the cap member and the flange member proximate the base edge of the flange member.

In one or more embodiments of the flexible drip cap described herein, the back edge of the cap member, the base edge of the flange member, and the inner edge of the seal member are attached to each other along a junction, and wherein the spine of the flexible drip cap comprises the junction of the back edge, the base edge, and the inner edge.

In one or more embodiments of the flexible drip cap described herein, the cap member comprises an inside surface facing the seal member and an outside surface facing away from the seal member, wherein the inside surface and the outside surface extend between the back edge and the front edge of the cap member along the length of the flexible drip cap, and wherein the front edge comprises a drip edge comprising a rounded profile in a cross-section taken transverse to the spine. In one or more embodiments, in any selected cross-section taken transverse to the spine along a majority of the length of the flexible drip cap, the rounded profile defines a radius of curvature equal to or greater than a thickness of the cap member measured between the inside surface and the outside surface at any location between the inner edge of the seal member and the rounded profile of the drip edge. In one or more embodiments, the radius of curvature is equal to or greater than the thickness of the cap member measured between the inside surface and the outside surface at any location between the inner edge of the seal member and the rounded profile of the drip edge in the selected cross-section over an arc of at least 90 degrees.

In one or more embodiments of the flexible drip cap described herein, the cap member comprises an inside surface facing the seal member and an outside surface facing away from the seal member, wherein the inside surface and the outside surface extend between the back edge and the front edge of the cap member along the length of the flexible drip cap, and wherein, in any selected cross-section taken transverse to the spine along a majority of the length of the flexible drip cap, the cap member comprises a cap member thickness measured transverse to the inside surface and the outside surface, and wherein the cap member thickness is greater proximate the front edge than proximate a midpoint between the back edge and the front edge of the cap member.

In one or more embodiments of the flexible drip cap described herein, the cap member comprises a stiffener located between back edge and the front edge of the cap member, wherein the stiffener is at least partially encapsulated in a covering polymeric material forming the back edge and the front edge of the cap member, and wherein the stiffener comprises a rear edge and a forward edge, wherein the rear edge is located between the forward edge and the back edge of the cap member, and wherein the forward edge is located between rear edge and the front edge of the cap member.

In one or more embodiments of a flexible drip cap including a stiffener, the rear edge of the stiffener is spaced apart from the back edge of the cap member, and wherein the forward edge of the stiffener is spaced apart from the front edge of the cap member.

In one or more embodiments of a flexible drip cap including a stiffener, the stiffener comprises a stiffener width measured transverse to the spine between the rear edge and the forward edge of the stiffener, and wherein the stiffener width is less than a cap member width measured transverse to the spine between the back edge and the front edge of the cap member.

In one or more embodiments of a flexible drip cap including a stiffener, the stiffener is completely encapsulated within the polymeric material.

In one or more embodiments of a flexible drip cap including a stiffener, the stiffener comprises a bending modulus about an axis aligned with the spine that is greater than a bending modulus of an equivalent body constructed of the polymeric material at least partially encapsulating the stiffener.

In one or more embodiments of a flexible drip cap including a stiffener, the stiffener comprises a metallic stiffener.

In one or more embodiments of a flexible drip cap including a stiffener, the flange member is constructed of the polymeric material at least partially encapsulating the stiffener in the cap member. In one or more embodiments, the seal member is constructed of a second polymeric material.

In one or more embodiments of the flexible drip cap described herein, the flange member comprises a plurality of fins, wherein each pair of adjacent fins is separated from each other by a slot extending towards the base edge of the flange member from the free edge of the flange member.

In one or more embodiments of the flexible drip cap described herein, the flange member and the seal member are attached to each other proximate the free edge of the flange member and the outer edge of the seal member. In one or more embodiments, at least a portion of the flange member is not attached to the seal member between the base edge of the flange member and the free edge of the flange member.

In a second aspect, one or more embodiments of flexible drip cap as described herein include: a spine extending along a length of the flexible drip cap; a cap member comprising a back edge and a front edge, wherein the back edge of the cap member extends along the spine of the flexible drip cap, and wherein the front edge of the cap member is spaced away from the back edge and the spine along the length of the flexible drip cap; a flange member comprising a base edge and free edge, wherein the base edge of the flange member extends along the spine of the flexible drip cap, and wherein the free edge of the flange member is spaced away from the base edge and the spine along the length of the flexible drip cap, wherein the flange member comprises a plurality of fins, wherein each pair of adjacent fins is separated from each other by a slot extending towards the base edge of the flange member from the free edge of the flange member; and a seal member comprising an inner edge and an outer edge, wherein the inner edge of the seal member extends along the spine of the flexible drip cap, and wherein the outer edge of the seal member is spaced away from the inner edge and the spine along the length of the flexible drip cap; wherein the spine of the flexible drip cap is formed by a junction between the back edge of the cap member and the base edge of the flange member; wherein the seal member extends away from the junction between the back edge of the cap member and the base edge of the flange member such that the seal member is located within an inside corner defined by the cap member and the flange member; wherein the cap member comprises an inside surface facing the seal member and an outside surface facing away from the seal member, wherein the inside surface and the outside surface extend between the back edge and the front edge of the cap member along the length of the flexible drip cap, and wherein the front edge comprises a drip edge comprising a rounded profile in a cross-section taken transverse to the spine; wherein the cap member comprises a stiffener located between back edge and the front edge of the cap member, wherein the stiffener is at least partially encapsulated in a covering polymeric material forming the back edge and the front edge of the cap member, and wherein the stiffener comprises a rear edge and a forward edge, wherein the rear edge is located between the forward edge and the back edge of the cap member, and wherein the forward edge is located between rear edge and the front edge of the cap member.

In one or more embodiments of the second aspect of flexible drip cap described herein, in any selected cross-section taken transverse to the spine along a majority of the length of the flexible drip cap, the rounded profile defines a radius of curvature equal to or greater than a thickness of the cap member measured between the inside surface and the outside surface at any location between the inner edge of the seal member and the rounded profile of the drip edge.

In one or more embodiments of the second aspect of flexible drip cap described herein, the rear edge of the stiffener is spaced apart from the back edge of the cap member, and wherein the forward edge of the stiffener is spaced apart from the front edge of the cap member.

In one or more embodiments of the second aspect of flexible drip cap described herein, the stiffener is completely encapsulated within the polymeric material.

In one or more embodiments of the second aspect of flexible drip cap described herein, the stiffener comprises a bending modulus about an axis aligned with the spine that is greater than a bending modulus of an equivalent body constructed of the polymeric material at least partially encapsulating the stiffener.

In one or more embodiments of the second aspect of flexible drip cap described herein, the flange member and the seal member are attached to each other proximate the free edge of the flange member and the outer edge of the seal member. In one or more embodiments, at least a portion of the flange member is not attached to the seal member between the base edge of the flange member and the free edge of the flange member.

In a third aspect, one or more embodiments of methods of installing flexible drip cap as described herein may include: deforming a flexible drip cap such that the cap member follows an upper surface of a fenestration unit and is oriented generally horizontal and the cam member is positioned against an outside surface a wall in which the fenestration unit is installed and oriented generally vertically.

In a fourth aspect, one or more embodiments of methods of installing flexible drip cap on a fenestration unit (wherein the flexible drip cap includes a cap member, a flange member, and a seal member, wherein a back edge of the cap member, a base edge of the flange member, and an inner edge of the seal member are attached to each other proximate a spine of the flexible drip cap, and wherein seal member is located between the cap member and the flange member when the cap member and the flange member are positioned such that the seal member is located within an arc of less than 180 degrees centered along the spine and extending from the cap member to the flange member) may include: deforming the cap member of the flexible drip cap such that the spine and the cap member of the flexible drip cap follow a curved path matching the shape of a top edge of a fenestration unit installed in a building opening; and attaching the cap member to the top edge of the fenestration unit such that the cap member is positioned on the top edge of the fenestration unit with the flange member and the seal member both positioned on and aligned with the building wall.

In one or more embodiments of methods according to the fourth aspect, the back edge of the cap member and the base edge of the flange member are attached to each other along a junction, and wherein the spine of the flexible drip cap comprises the junction of the back edge and the base edge. In one or more embodiments, the inner edge of the seal member is attached to the cap member proximate the back edge of the cap member, the flange member proximate the base edge of the flange member, or the cap member proximate the back edge of the cap member and the flange member proximate the base edge of the flange member.

In one or more embodiments of methods according to the fourth aspect, the back edge of the cap member, the base edge of the flange member, and the inner edge of the seal member are attached to each other along a junction, and wherein the spine of the flexible drip cap comprises the junction of the back edge, the base edge, and the inner edge.

In one or more embodiments of methods according to the fourth aspect, the cap member comprises an inside surface facing the seal member and an outside surface facing away from the seal member, wherein the inside surface and the outside surface extend between the back edge and a front edge of the cap member along the length of the flexible drip cap, and wherein the front edge comprises a drip edge comprising a rounded profile in a cross-section taken transverse to the spine.

In one or more embodiments of methods according to the fourth aspect, the cap member comprises an inside surface facing the seal member and an outside surface facing away from the seal member, wherein the inside surface and the outside surface extend between the back edge and a front edge of the cap member along the length of the flexible drip cap, and wherein, in any selected cross-section taken transverse to the spine along a majority of the length of the flexible drip cap, the cap member comprises a cap member thickness measured transverse to the inside surface and the outside surface, and wherein the cap member thickness is greater proximate the front edge than proximate a midpoint between the back edge and the front edge of the cap member.

In one or more embodiments of methods according to the fourth aspect, the cap member comprises a stiffener located between back edge and a front edge of the cap member, wherein the stiffener is at least partially encapsulated in a covering polymeric material forming the back edge and the front edge of the cap member, and wherein the stiffener comprises a rear edge and a forward edge, wherein the rear edge is located between the forward edge and the back edge of the cap member, and wherein the forward edge is located between rear edge and the front edge of the cap member.

In one or more embodiments of methods according to the fourth aspect including a stiffener, the rear edge of the stiffener is spaced apart from the back edge of the cap member, and wherein the forward edge of the stiffener is spaced apart from the front edge of the cap member.

In one or more embodiments of methods according to the fourth aspect including a stiffener, the stiffener comprises a stiffener width measured transverse to the spine between the rear edge and the forward edge of the stiffener, and wherein the stiffener width is less than a cap member width measured transverse to the spine between the back edge and the front edge of the cap member.

In one or more embodiments of methods according to the fourth aspect, the flange member comprises a plurality of fins, wherein each pair of adjacent fins is separated from each other by a slot extending towards the base edge of the flange member from a free edge of the flange member, and wherein deforming the cap member of the flexible drip cap such that the spine and the cap member of the flexible drip cap follow a curved path causes the pairs of adjacent fins to move away from each other proximate the free of the flange member.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description.

Moreover, "a," "an," "the," "at least one," and "one or more" are used interchangeably herein.

Where used herein, the terms "top" and "bottom" are used for reference relative to each other when the drip cap is installed on a fenestration unit in a building opening.

Where used herein, the terms "exterior" and "interior" are used in a relative sense, e.g., an exterior edge and an interior edge on a fenestration unit or any other component describe edges located on opposite sides of the fenestration unit. In other words, an exterior edge could be found within the interior of a building or other structure that would conventionally define an interior and an exterior, while an interior edge could be found outside of a building or other structure that would conventionally define an interior and an exterior.

The above summary is not intended to describe each embodiment or every implementation of the flexible drip cap described herein. Rather, a more complete understanding of the invention will become apparent and appreciated by reference to the following Description of Illustrative Embodiments and claims in view of the accompanying figures of the drawing.

Figure 1A:
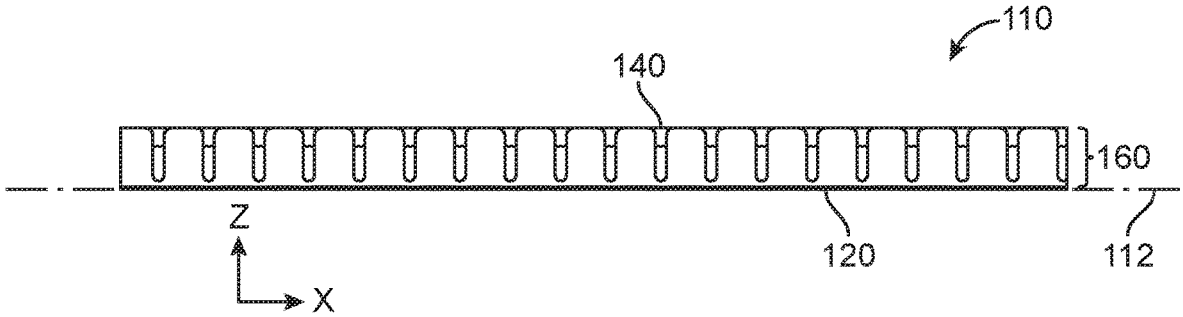
FIG. 1A depicts one illustrative embodiment of a flexible drip cap as described herein in a rear elevation view.

The axes of a Cartesian coordinate system are depicted in the figures to assist the viewer in understanding the various components and views of the drawing. The axes are for relationship purposes only and no particular orientation for any of the axes is implied (e.g., the Z-axis may or may not be aligned with the direction of gravitational force).

DESCRIPTION OF ILLUSTRATIVE EMBODIMENTS

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

Figure 1B:
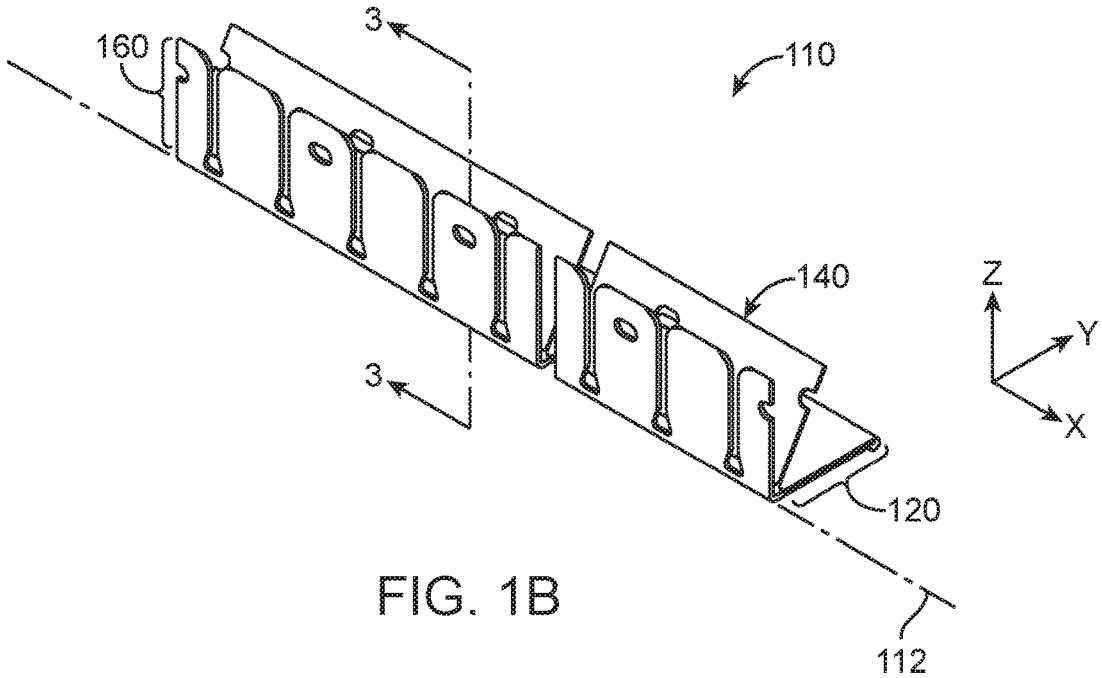
FIG. 1B is a rear perspective view of the flexible drip cap of FIG. 1A.

One illustrative embodiment of a length of drip cap 110 as described herein is depicted in a front elevation view in FIG. 1A and a rear perspective view in FIG. 1B. The drip cap 110 includes a cap member 120, seal member 140, and flange member 160, all of which are attached to each other along a common edge aligned with axis 112 that is, in turn, aligned with the x-axis in the depicted view. Although the drip cap 110 is depicted as aligned with a straight axis 112, it can be deformed or shaped by bending about the y-axis such that the cap member 120 forms a curved shape to, e.g., follow the top edge of a fenestration unit.

Figure 2A:
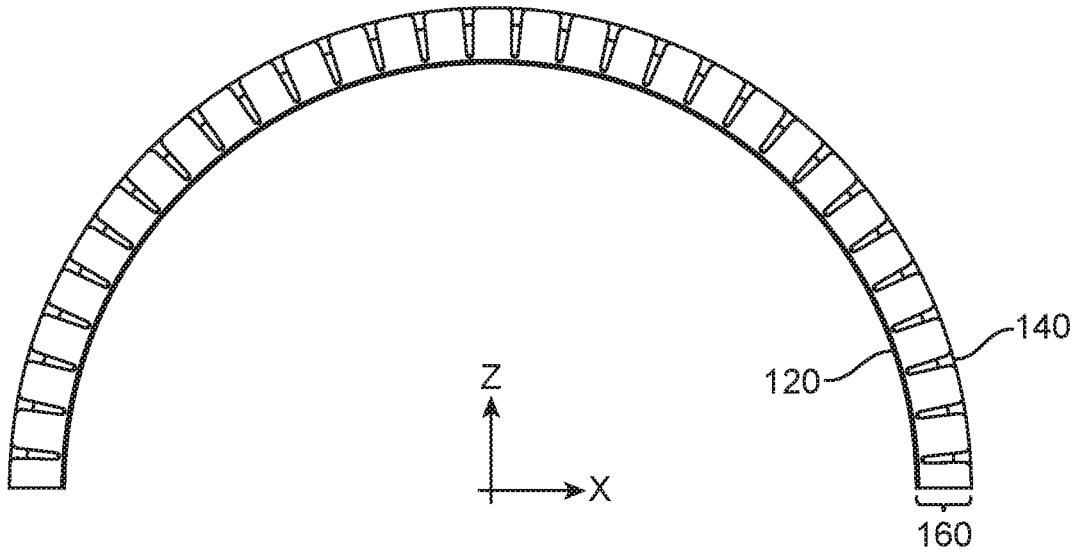
FIG. 2A is a rear elevation view of the flexible drip cap of FIG. 1A after being deformed or bent around the y-axis as seen in FIG. 2A.
Figure 2B:
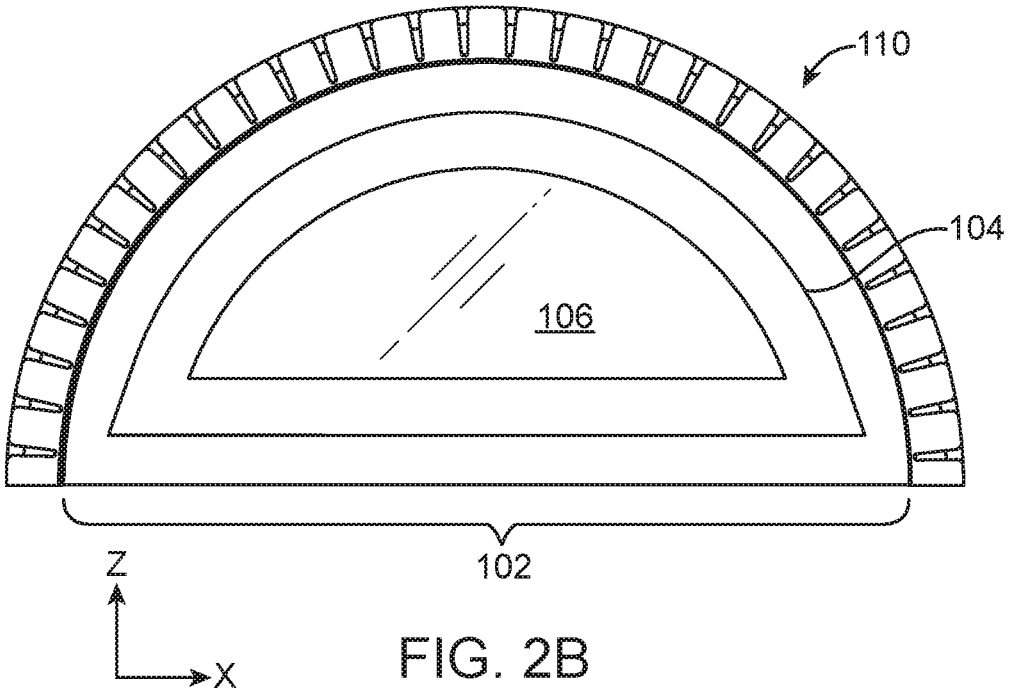
FIG. 2B is a rear elevation view of the flexible drip cap of FIG. 2A in position on a tope edge of a frame of a fenestration unit having a curved top.

One illustrative embodiment of a method of installing a flexible drip cap as described herein on a fenestration unit is depicted in FIGS. 2A-2B. The flexible drip cap 110 of FIG. 1A is depicted in FIG. 2A after being deformed into a curved configuration by bending the flexible drip cap 110 about the y-axis. Although the depicted deformed or bent flexible drip cap has a uniformly curved shape, it will be understood that the flexible drip cap may take any suitable shape (within the physical limits of its flexibility) to match the shape of the top edge of a fenestration unit on which the flexible drip cap 110 is to be installed. For example, as seen in FIG. 2B, the curved configuration of the flexible drip cap 110 matches the shape of the top edge of the frame 104 of the depicted fenestration unit 102 (which includes a glazing panel 106).

In one or more embodiments of the methods of installing a flexible drip cap as described herein, the flexible drip cap can be deformed by hand or with non-powered hand tools such that the deformed or bent flexible drip cap conforms to the shape of the fenestration unit on which it is to be installed (e.g., an installer can take a straight/undeformed length of the flexible drip cap and form it to the desired shape at a building site without requiring the use of driven rollers, etc. as might be commonly used to form sheet metal and similar materials).

Methods of installing a flexible drip cap as discussed herein may further include attaching the cap member 120 to the top edge of the frame 104 of the fenestration unit 102 such that the cap member 120 is positioned on the top edge of the fenestration unit and the flange member 160 and seal member 140 are positioned on and aligned with the building wall surrounding the building opening in which the fenestration unit 102 is installed. Typically, the seal member 140 and flange member 160 may be covered by a barrier plane (e.g., siding, etc.) of the building wall in which the fenestration unit is installed, such that water flowing down the wall is prevented from flowing behind the barrier plane and is, instead, shed by the cap member 120.

Figure 2C:
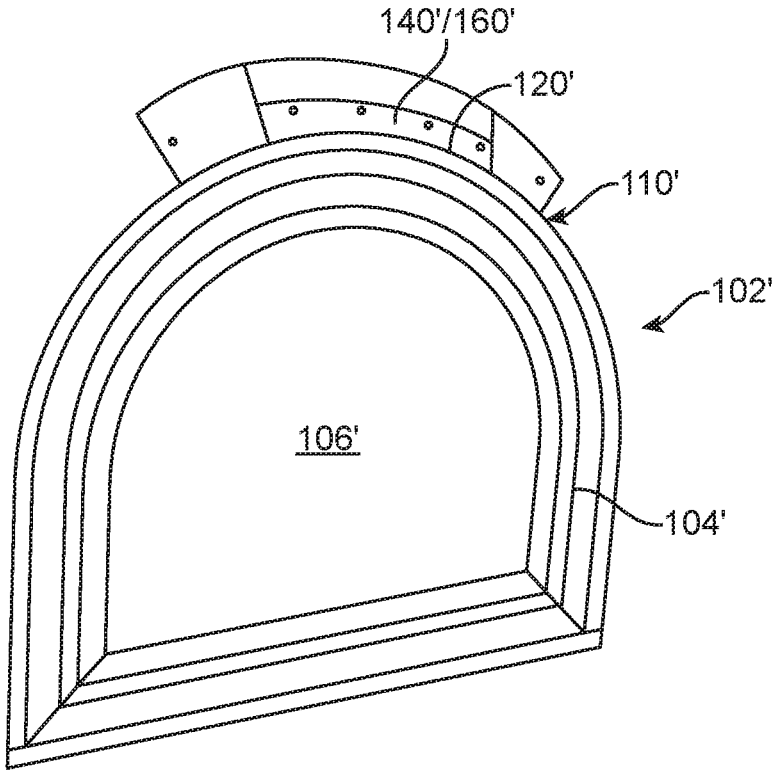
FIG. 2C depicts another illustrative of one illustrative embodiment of a flexible drip cap as described herein installed above a fenestration unit having a curved top.

Another illustrative embodiment of a fenestration unit 102' having a frame 104' surrounding a glazing panel 106' is depicted in FIG. 2C. The top edge of the frame 104' is curved and the drip edge 110' is curved or shaped to follow that top edge, with the cap member 120' positioned on top of the frame 104', with the seal member 140' and flange member 160' positioned on the wall surrounding the building opening in which the fenestration unit 102' is located. The seal member 140' and flange member 160' are exposed in the view of FIG. 2C but are typically positioned underneath a barrier plane of the building wall in which the fenestration unit is installed, such that, as noted above in connection with FIG. 2B, water flowing down the wall is prevented from flowing behind the barrier plane and is, instead, shed by the cap member 120'.

Figure 3:
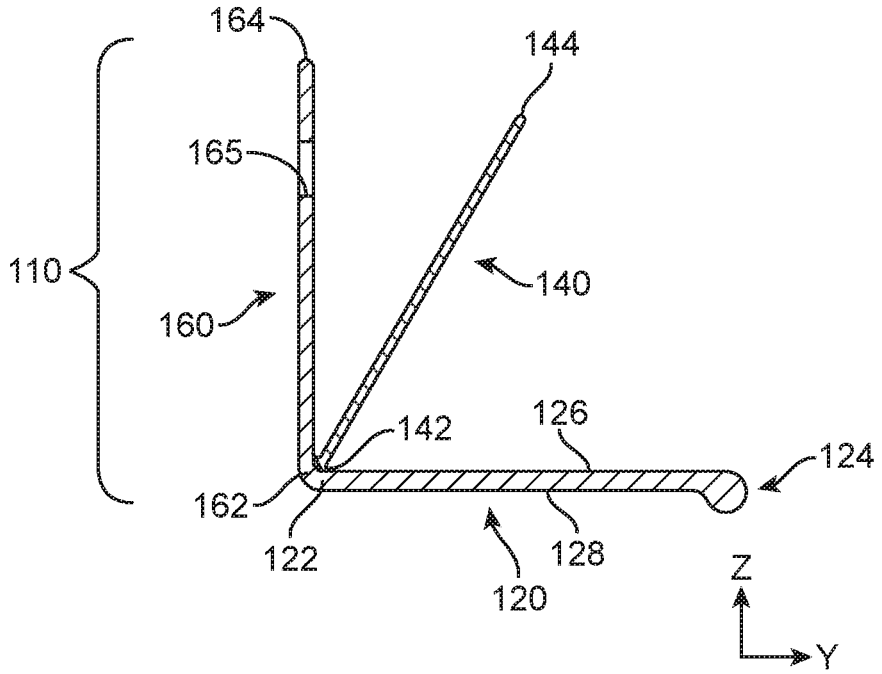
FIG. 3 is an enlarged cross-sectional view of the flexible drip cap of FIG. 1B taken along line 3-3 in FIG. 1B.
Figure 4:
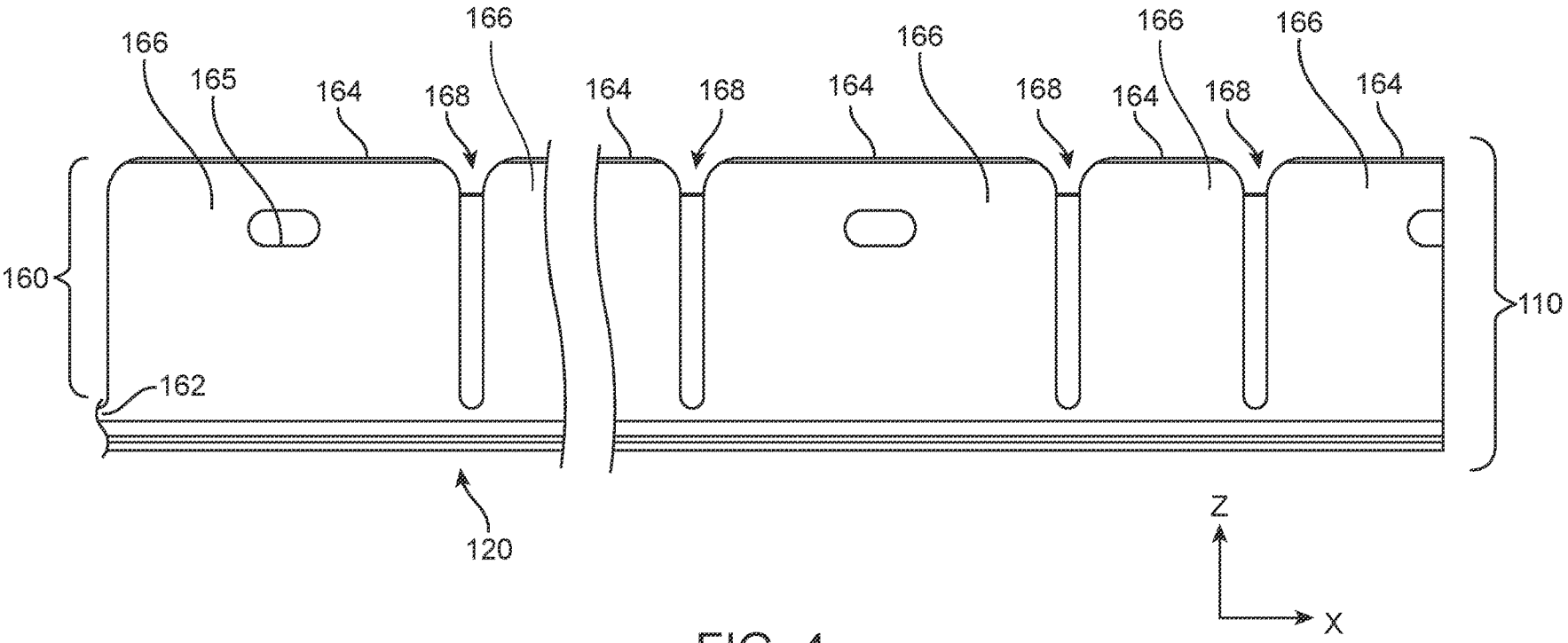
FIG. 4 is an enlarged view of the flexible drip cap of FIG. 1B taken along the y-axis.

The illustrative embodiment of drip cap 110 is depicted in a profile view in FIG. 3 (taken along the x-axis of FIG. 1) and a plan view in FIG. 4. The drip cap 110 can be described as having a spine at the junction between the cap member 120 and the flange member 160. With reference to FIG. 1B, the spine can be described being located and extending along the axis 112 for the length of the drip cap 110.

The cap member 120 of the depicted illustrative embodiment of drip cap 110 includes a back edge 122 and a front edge 124, with the back edge 122 of the cap member 120 extending along the spine of the flexible drip cap 110. The front edge 124 of the cap member 120 is spaced away from the back edge 122 and the spine along the length of the flexible drip cap 110.

The seal member 140 of the depicted illustrative embodiment of drip cap 110 includes an inner edge 142 and an outer edge 144. The inner edge 142 of the seal member 140 extends along the spine of the flexible drip cap 110. The outer edge 144 of the seal member 140 is spaced away from the inner edge 142 and the spine along the length of the flexible drip cap 110.

The flange member 160 includes a base edge 164 and a free edge 164. The base edge 164 of the flange member 160 extends along the spine of the flexible drip cap 110 and the free edge 164 of the flange member 160 is spaced away from the base edge 162 and the spine along the length of the flexible drip cap 110.

In the depicted illustrative embodiment of drip cap 110, the back edge 122 of the cap member 120 and the base edge 162 of the flange member 160 are attached to each other proximate the spine of the flexible drip cap 110 such that the cap member 120 and the flange member 160 define an inside corner of the flexible drip cap 110 when the cap member 120 and the flange member 160 are positioned such that the seal member 140 is located within an arc of less than 180 degrees centered along the spine and extending from the cap member 120 to the flange member 160.

Although the back edge 122 of the cap member 120 and the base edge 162 of the flange member 160 are, in one or more embodiments of a flexible drip cap as described herein, attached to each other continuously along the length of the flexible drip cap 110, the back edge 122 and the base edge 162 may be intermittently attached to each other along the length of the flexible drip cap 110. In such an embodiment, however, the inner edge 142 of the seal member 140 is preferably continuously attached to the back edge 122 of the cap member 120 such that water infiltration between the junction of the back edge 122 of the cap member 120 and the inner edge 142 of the seal member 140 is prevented.

In one or more embodiments of a flexible drip cap as described herein, the back edge 122 of the cap member 120 and the base edge 162 of the flange member 160 may be attached to each other along a junction, with that junction between the back edge 122 and base edge 162 being described as forming the spine of the flexible drip cap 110. In one or more embodiments of a flexible drip cap as described herein, the inner edge 142 of the seal member 140 may be described as being attached to the cap member proximate the back edge 122 of the cap member 120.

In one or more embodiments of a flexible drip cap as described herein, the inner edge 142 of the seal member 140 may be described as being attached to the flange member 160 proximate the base edge 162 of the flange member 160.

In one or more embodiments of a flexible drip cap as described herein, the inner edge 142 of the seal member 140 may be described as being attached to both the cap member 120 proximate its back edge 122 and the flange member 160 proximate its base edge 162.

In one or more embodiments of a flexible drip cap as described herein, the back edge 122 of the cap member 120, the base edge 162 of the flange member 160, and the inner edge 142 of the seal member 140 are attached to each other along a junction, with the junction between the back edge 122, the base edge 162 and the inner edge 142 being described as forming the spine of the flexible drip cap 110.

In the depicted illustrative embodiment of flexible drip cap 110 as seen in, e.g., FIG. 4, the flange member 160 includes a plurality of fins 166. Each pair of adjacent fins 166 may be described as being separated from each other by a slot 168 extending towards the base edge 162 of the flange member 160 from the free edge 164 of the flange member 160. In one or more embodiments of a flexible drip cap including a plurality of fins forming the flange member, the free edges 164 of each of fins 166 may be described as collectively forming the common free edge of the flange member 160, i.e., the free edge 164 may be discontinuous along the length of the flexible drip cap.

The fins 166 and slots 168 may facilitate bending of the flexible drip cap 110 about the y-axis when installing the flexible drip cap 110 on a fenestration unit as described herein. In particular, bending of the flexible drip cap 110 about the y-axis will typically result in widening of the slot 168 proximate the free edge 164 of the flange member 160 such that the slot 168 takes on a generally triangular shape.

In one or more embodiments, the fins 166 may have different lengths along the x-axis (as seen in, e.g., FIG. 4), but in alternative embodiments the fins of a flange member of a flexible drip cap as described herein may have a uniform length along that axis. Another alternative feature depicted in FIG. 4 is that one or more of the fins 166 may include apertures 165 to facilitate attachment of the flange member 160 to a building wall using any suitable fastener e.g. nails, threaded fasteners, rivets, etc.

In the depicted illustrative embodiment of the flexible drip cap 110, the cap member 120 may be described as including an inside surface 126 facing the seal member 140 and an outside surface 128 facing away from the seal member 140. The inside surface 126 and outside surface 128 extend between the back edge 122 and the front edge 124 of the seal member along the length of the flexible drip cap 110.

Figure 5:
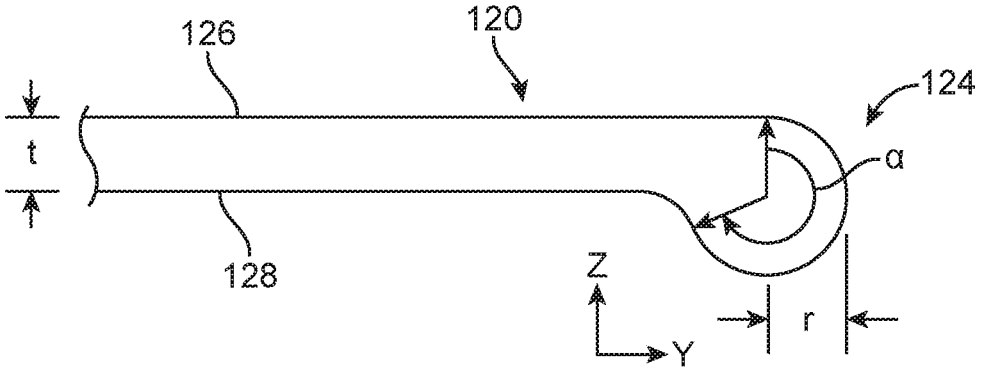
FIG. 5 is an enlarged view of the front edge portion of the cap member of the flexible drip cap as depicted in FIG. 3.

In one or more embodiments of the flexible drip cap as described herein, the front edge 124 of the cap member 120 includes a drip edge in the form of a rounded profile in a cross-section taken transverse to the spine (i.e. transverse to the x-axis) in FIGS. 3 and 5 depicting one illustrative embodiment of flexible drip cap 110.

In one or more embodiments, the rounded profile of a drip edge may define a radius of curvature equal to or greater than a thickness of the cap member 120, where the thickness of the cap member 120 is measured between the inside surface 126 and the outside surface 128 at any location between the inner edge 122 of the seal member 120 and the rounded profile of the drip edge at the front edge 124 of the seal member 120. With reference to FIG. 5, the cap member 120 has a thickness t between the inside surface 126 and the outside surface 128. Further, the rounded profile of the drip edge at the front edge 124 defines a radius of curvature r over at least a portion of the front edge 124 of the cap member 120. As described herein, in one or more embodiments of a flexible drip cap as described herein, the radius of curvature may be equal to or greater than the thickness of the cap member 120, i.e., (with reference to FIG. 5) r≥t.

Providing a drip edge having a rounded profile at the front edge 124 of the cap member 120 may facilitate the shedding of water flowing across inside surface 126 towards front edge 124 of the cap member 120 while minimizing the amount of water following the front edge 124 of the cap member 120 and reaching the outside surface 128 of the cap member 120. In other words, water flowing over the inside surface 126 and around the rounded profile at the front edge 124 will preferentially separate from the surface of the front edge 124 without reaching the outside surface 128.

In one or more embodiments of the flexible drip cap described herein in which the front edge of the cap member has a rounded profile, the front edge may have a rounded profile over an arc of 45° or more, 90° or more, 120° or more, 150° or more, or 180° or more. In one or more embodiments of the flexible drip cap described herein, the rounded profile may extend over an arc of 270° or less, 240° or less, 210° or less, 180° or less, 150° or less, 120° or less, or 90° or less. With reference to FIG. 5, the arc over which the rounded profile extends may be defined by angle α (alpha).

In one or more embodiments of the flexible drip cap described herein in which the front edge of the cap member has a rounded profile, the rounded profile may have a constant radius of curvature over any selected arc. In one or more alternative embodiments, the front edge of the cap member may have a rounded profile with a varying radius of curvature over one or more selected arcs.

With reference to FIG. 3, one or more components of one or more embodiments of the flexible drip cap described herein may be constructed of polymeric materials that are semi-rigid or flexible depending on the components such as, e.g., polyvinyl chloride (PVC), etc. In particular, the cap member 120 and flange member 160 in the depicted illustrative embodiment of flexible drip cap 110 are both constructed of the same polymeric material as indicated by the uniform crosshatching in the cross-sectional view of FIG. 3. In one or more embodiments, the polymeric material used for the cap member and the flange member may be a semi-rigid PVC, while the seal member may be constructed of a different polymeric material that is more flexible than the polymeric material used to construct the cap member and flange member. For example, the flexible seal could be manufactured of a flexible PVC.

The semi-rigid polymeric material used for the cap member and/or flange member of flexible drip cap as described herein may, in one or more embodiments, be distinguished from the flexible polymeric material used for the flexible seal on the basis of elongation at break. In one or more embodiments, the flexible seal may be constructed of polymeric material that withstands substantially higher elongation at break than the polymeric material used to construct the cap member and flange member at 68 degrees Fahrenheit.

In one or more embodiments, the flexible polymeric material used for the flexible seal member may withstand elongation at break (as expressed in relative terms) that is two or more times, three or more times, or even four or more times the elongation at break exhibited by the semi-rigid polymeric materials used in the cap member and/or flange member at 68 degrees Fahrenheit.

In one or more embodiments, the flexible polymeric material used for the flexible seal member may withstand elongation at break (as expressed in percent elongation at 68 degrees Fahrenheit) of 100% or more, 150% or more, 200% or more, 250% or more, or even 300% or more. Although always lower than the elongation at break of the flexible polymeric material, the semi-rigid polymeric material used in the cap member and/or flange member for a given flexible drip cap construction may withstand elongation at break (as expressed in percent elongation at 68 degrees Fahrenheit) of 100% or less, 75% or less, or 50% or less.

In one or more embodiments, at least a portion of the cap member and, in some instances, the flange member, may be coated with one or more materials to improve weatherability, appearance (e.g., color), paintability, etc. Some potentially suitable coating materials may be manufactured of an acrylic, etc.

Figure 6:
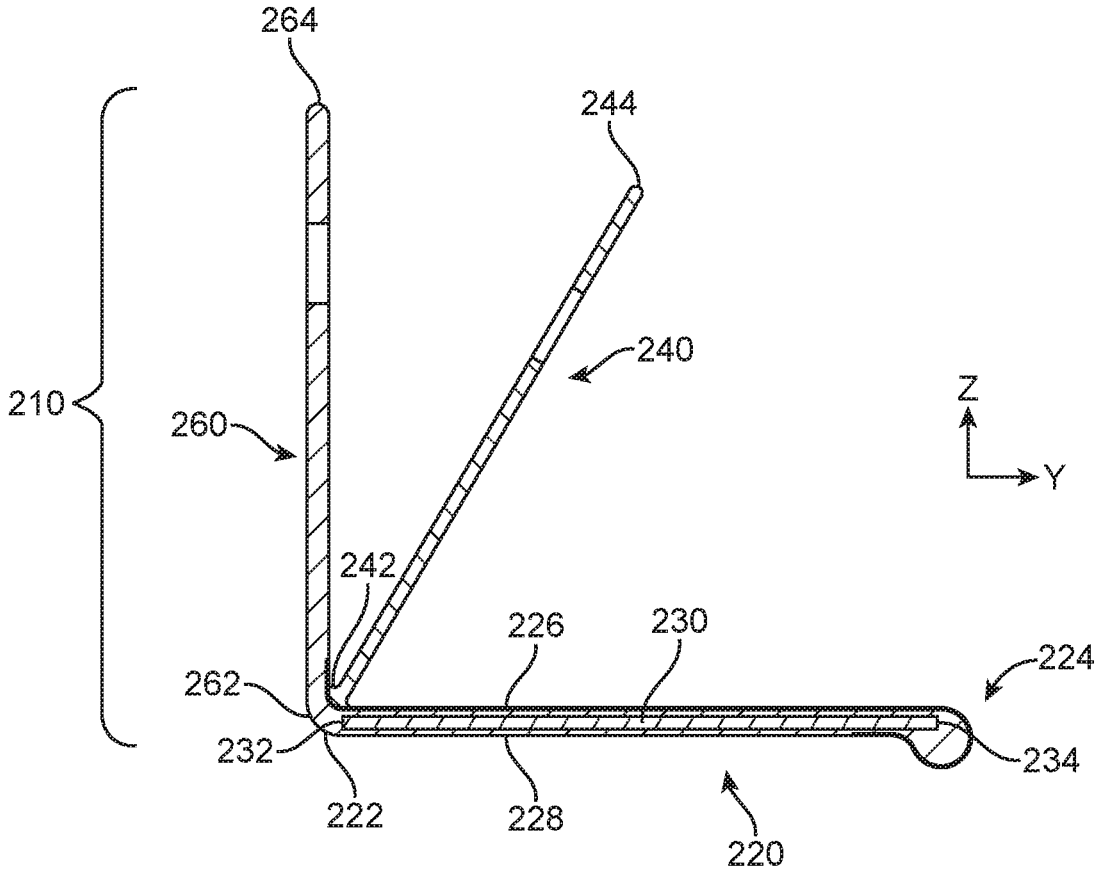
FIG. 6 is an enlarged cross-sectional view of another illustrative embodiment of a flexible drip cap as described herein.

One or more embodiments of flexible drip cap as described herein may include a stiffener as a part of the cap member, with the stiffener providing more structural support for the cap member while still allowing for bending of the cap member to follow the shape of a fenestration unit frame as described herein. One illustrative embodiment of a flexible drip cap 210 including a stiffener is depicted in a cross-sectional view in FIG. 6. As seen in FIG. 6, the flexible drip cap 210 includes a cap member 220, seal member 240, and flange member 260. The cap member includes a back edge 222 and a front edge 224 along with an insight surface 226 and an outside surface 228 similar to the same features found in other illustrative embodiments of flexible drip cap as described herein. The seal member 240 also includes an inner edge 242 and an outer edge 244 similar to the same features found in other illustrative embodiments of flexible drip cap as described herein. Finally, the flange member 260 includes a base edge 262, a free edge 264, and a fastener aperture 265 similar to the same features found in other illustrative embodiments of flexible drip cap as described herein.

The depicted illustrative embodiment of flexible drip cap 210 also includes, however, a stiffener 230 located within the cap member 220. The stiffener 230 is located between the back edge 222 and the front edge 224 of the cap member 220. In one or more embodiments the stiffener 230 is encapsulated in a covering polymeric material forming the back edge 222 and the front edge 224 of the cap member 220. Although the depicted illustrative embodiment seen in FIG. 6 includes a stiffener 230 completely encapsulated in polymeric material forming the cap member 220, one or more alternative embodiments of a flexible drip cap as described herein may include a stiffener that is only partially encapsulated in a covering polymeric material forming the remainder of the cap member.

In the depicted illustrative embodiment of flexible drip cap 210, the stiffener 230 has a rear edge 232 and a forward edge 234, with the rear edge 232 being located between the between the forward edge 234 of the stiffener 230 and the back edge 222 of the cap member 220. The depicted illustrative embodiment of flexible drip cap 210 also includes a stiffener 230 having a forward edge 234 that is located between the rear edge 232 of the stiffener 230 and the front edge 224 of the cap member 220.

In the depicted illustrative embodiment, the rear edge 232 of the stiffener 230 may be described as being spaced inward from the back edge 222 of the cap member 220, while the forward edge 234 of the stiffener 230 is spaced inward from the front edge 224 of the cap member 220. As a result, the rear edge 232 and the forward edge 234 of the stiffener 230 are, in the depicted illustrative embodiment of flexible drip cap 210, encapsulated within the polymeric material forming the remainder of the cap member 220. Such an arrangement between the stiffener 230 and the cap member 220 may further be characterized in terms of width where, for example, the stiffener 230 has a stiffener width measured transverse to the spine of the flexible drip cap 210 between the back edge 222 and the front edge 224 of the cap member 220, with the stiffener width being less than a cap member width measured transverse to the spine of the flexible drip cap 210 between the back edge 222 in the front edge 224 of the cap member 220.

In embodiments of the flexible drip cap as described herein having a cap member that includes a stiffener, the stiffener may be manufactured of any suitable material (or combination of materials) that is compatible with any polymeric material used to partially or completely encapsulate the stiffener. Regardless of its specific instruction, the stiffener may be described as having a bending modulus about an axis aligned with the spine of the flexible drip cap that is greater than a bending modulus of an equivalent body constructed of the polymeric material that at least partially encapsulates the stiffener. As a result, the stiffener preferably provides improve structural integrity to the cap member of the flexible drip cap incorporating the stiffener.

Examples of potentially suitable materials for stiffeners used in one or more embodiments of flexible drip cap as described herein may include, e.g., metals (e.g. aluminum, aluminum alloys, stainless steel, etc.), composite structures (e.g., fiberglass composites, carbon fiber composites, KEVLAR™ composites, etc.), polymers (e.g., ultra-high molecular weight polypropylene, nylons, acetal, urethane, etc.), etc.

Figure 7:
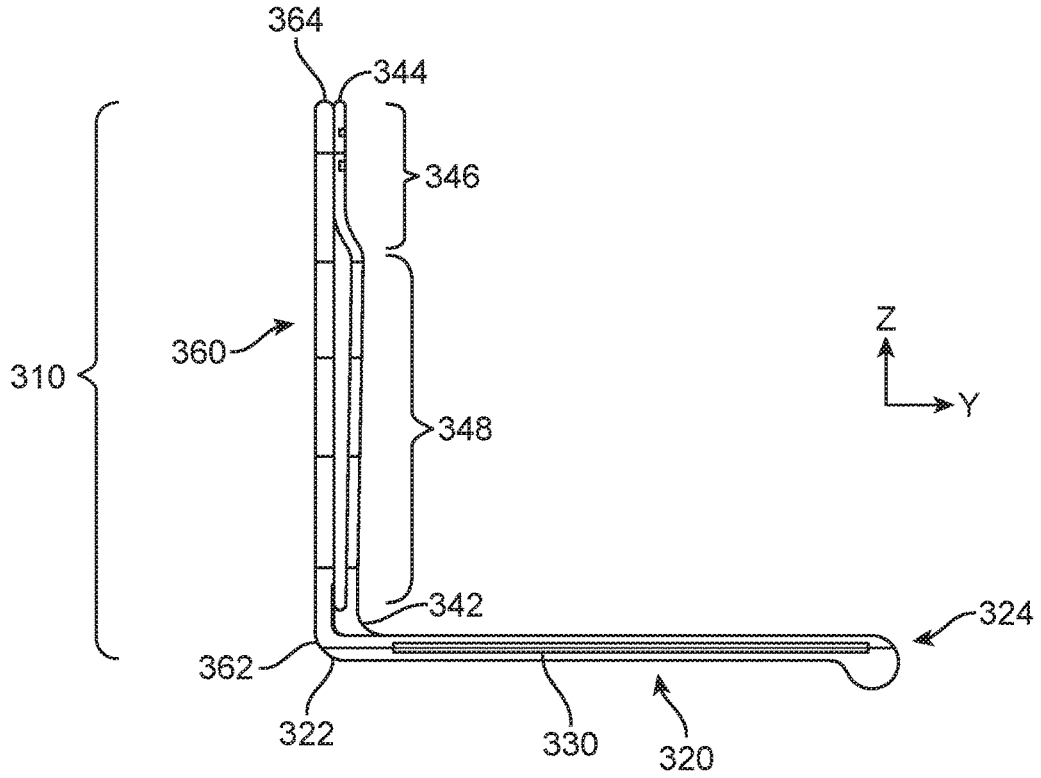
FIG. 7 is an enlarged cross-sectional view of another illustrative embodiment of a flexible drip cap as described herein including a seal member attached to the flange member of the flexible drip cap.

Another alternative illustrative embodiment of a flexible drip cap 310 as described herein is depicted in FIG. 7. As in other embodiments of the flexible drip cap described herein, the flexible drip cap 310 includes a cap member 320 having a back edge 322 and a front edge 324 and containing a stiffener 330 therein. The flexible drip cap 310 also includes a seal member 340 having an inner edge 342 and an outer edge 344, along with a flange member 360 including a base edge 362 and a free edge 364. One optional feature that may be provided in one or more embodiments of flexible drip cap as described herein is that the seal member and the flange member may be attached to each other proximate the free edge of the flange member and the outer edge of the seal member.

In the depicted illustrative embodiment of flexible drip cap 310, a portion 346 of the seal member 340 proximate the outer edge 344 of the seal member 340 is attached to the flange member 360. The seal member 340 may be attached to the flange member 360 using any suitable technique or combination of techniques including, but not limited to, thermal welding (e.g., ultrasonic welding, etc.), chemical welding, adhesives, etc.

Furthermore, the seal member 340 may be attached to the flange member 360 at discrete locations separated from each other along the length of the flexible drip cap 310. If the flange member 360 includes fins as described elsewhere herein, the seal member 340 may be attached to the fins of the flange member 360 along every fin of the flange member 360 or along only selected fins of the flange member 360.

In embodiments of flexible drip cap as described herein in which the seal member is attached to the flange member, at least a portion of the flange member may, in one or more embodiments, not be attached to the seal member between the base edge of the flange member and the free edge of the flange member. With reference to the depicted illustrative embodiment of flexible drip cap 310, portion 348 of seal member 340 located between the inner edge 342 of the seal member 340 and the attached portion 346 of the seal member 340 is not attached to the flange member 360 (i.e., is detached from the flange member 360). Limiting the portion of the seal member attached to the flange member may, for example, improve flexibility of the flexible drip cap 310 when bending the flexible drip cap 310 around the y-axis to follow the shape of a fenestration unit frame.

Figure 8:
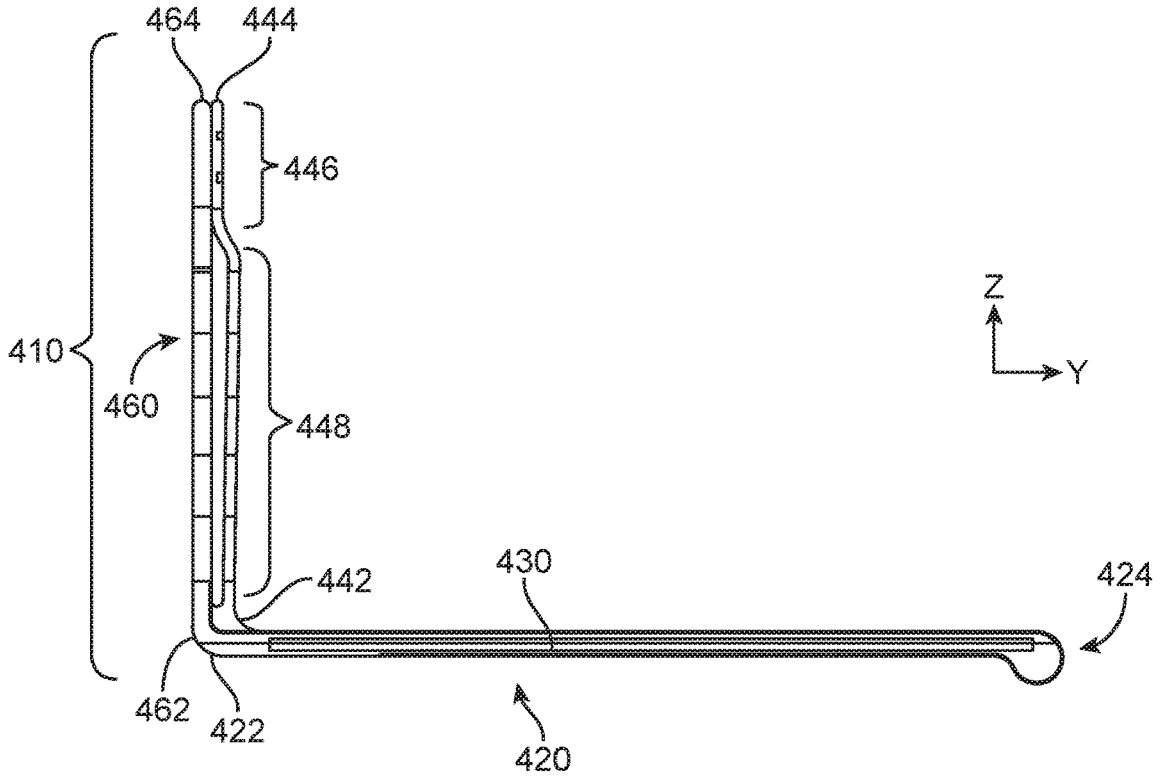
FIG. 8 is an enlarged cross-sectional view of another illustrative embodiment of a flexible drip cap including a wider cap member.

Another alternative illustrative embodiment of a flexible drip cap 410 as described herein is depicted in FIG. 8. As in other embodiments of the flexible drip cap described herein, the flexible drip cap 410 includes a cap member 420 having a back edge 422 and a front edge 424 and containing a stiffener 430 therein. The flexible drip cap 410 also includes a seal member 440 having an inner edge 442 and an outer edge 444, along with a flange member 460 including a base edge 462 and a free edge 464. A portion 446 of the seal member 440 proximate the outer edge 444 of the seal member 440 is attached to the flange member 460 and a portion 448 of the seal member 440 between portion 446 and the inner edge 442 of the seal member 440 is detached from the flange number 460.

One optional feature depicted in connection with the flexible drip cap 410 is in the distance between the back edge 422 and front edge 424 of the cap member 420. In particular, the flexible drip cap 410 includes a wider cap member 420 which may be used in connection with fenestration unit frames having wider frame members.

Figure 9:
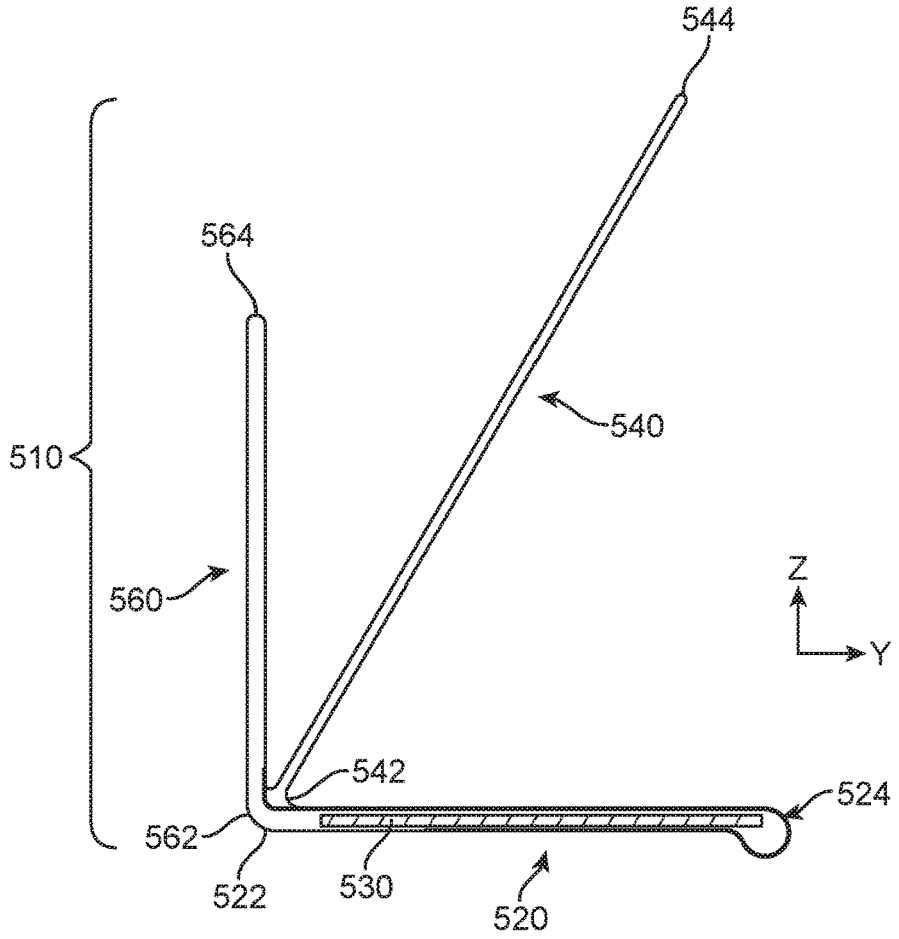
FIG. 9 is an enlarged cross-sectional view of another illustrative embodiment of a flexible drip cap including a wider seal member.
Figure 10:
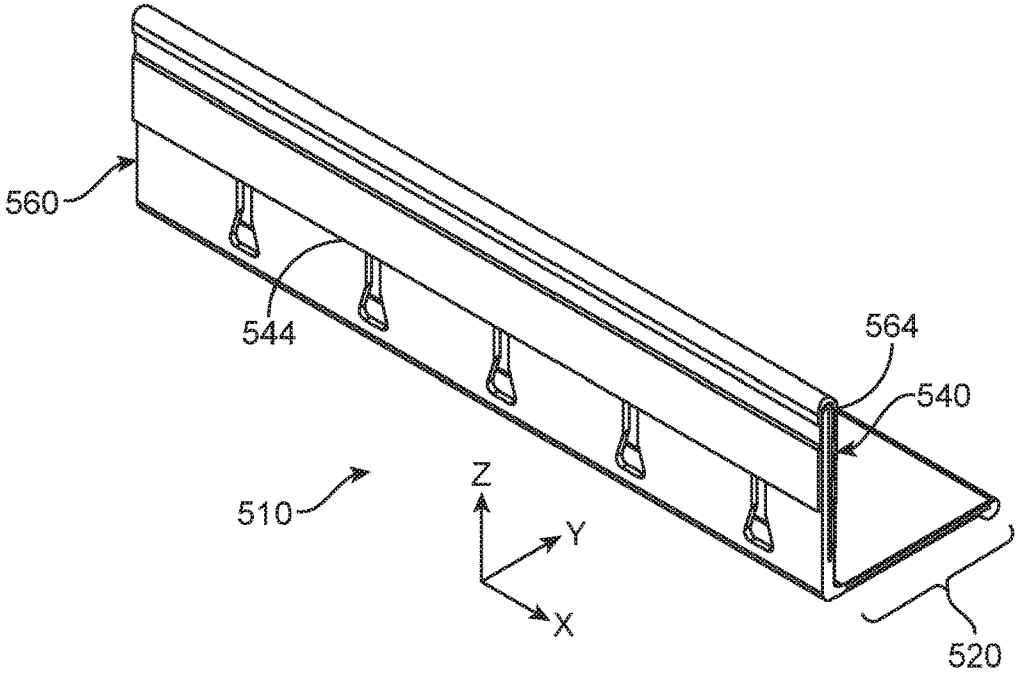
FIG. 10 is a perspective view of the flexible drip cap depicted in FIG. 9 in which the seal member is folded over a free edge of the flange member.
Figure 11:
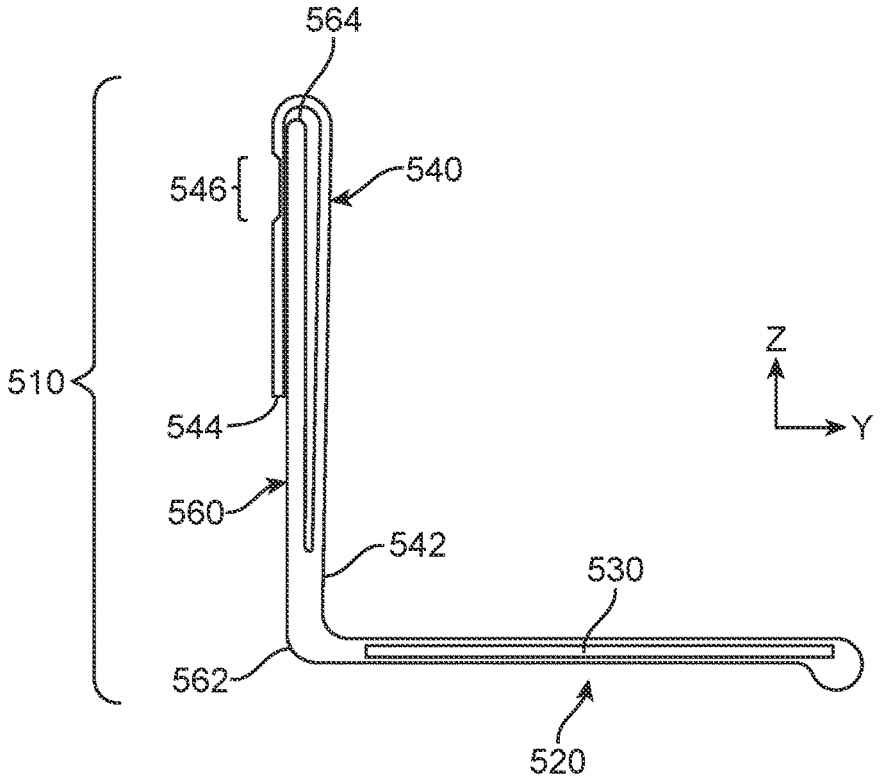
FIG. 11 is an enlarged end view of the flexible drip cap of FIG. 10.

Another illustrative embodiment of a flexible drip cap as described herein is depicted in connection with FIGS. 9-11. With reference to FIG. 9, the flexible drip cap 510 includes a cap member 520 having a back edge 522 and a front edge 524 along with a stiffener 530 located therein. The flexible drip cap 510 also includes a seal member 540 having an inner edge 542 and an outer edge 544 along with a flange member 560 having a base edge 562 and a free edge 564. The back edge 522 inner edge 542 and base edge 562 are all attached proximate a spine of the flexible drip cap 510 as described in connection with other illustrative embodiments of flexible drip cap described herein.

One optional feature depicted in connection with flexible drip cap 510 is the distance between the inner edge 542 and the outer edge 544 of the seal member 540. In particular, the width of the seal member 540 between those edges is greater than the distance between the base edge 562 and the free edge 564 of the flange member 560. As a result, the seal member 540 can be folded over the free edge 564 of the flange member 560. The perspective view depicted in FIG. 10 and the profile view depicted in FIG. 11 show the seal member 540 folded over the free edge 564 of the flange member 560 such that the outer edge 544 of the seal number 540 is located on the backside of the flange member 560.

In one or more embodiments, the seal member 540 may be attached to the flange member 560. In particular, the depicted embodiment includes an attached portion 546 of seal member 540 where seal member 540 is attached to the backside of the flange member 560. In the depicted illustrative embodiment, the attached portion 546 is located between the outer edge 544 of seal member 540 and free edge 564 of flange member 560. The same technique or combination of techniques used to attach portion 346 of seal member 342 flange member 360 of flexible drip cap 310 may be used to attach seal member 542 flange member 560 in flexible drip cap 510.

Figure 12:
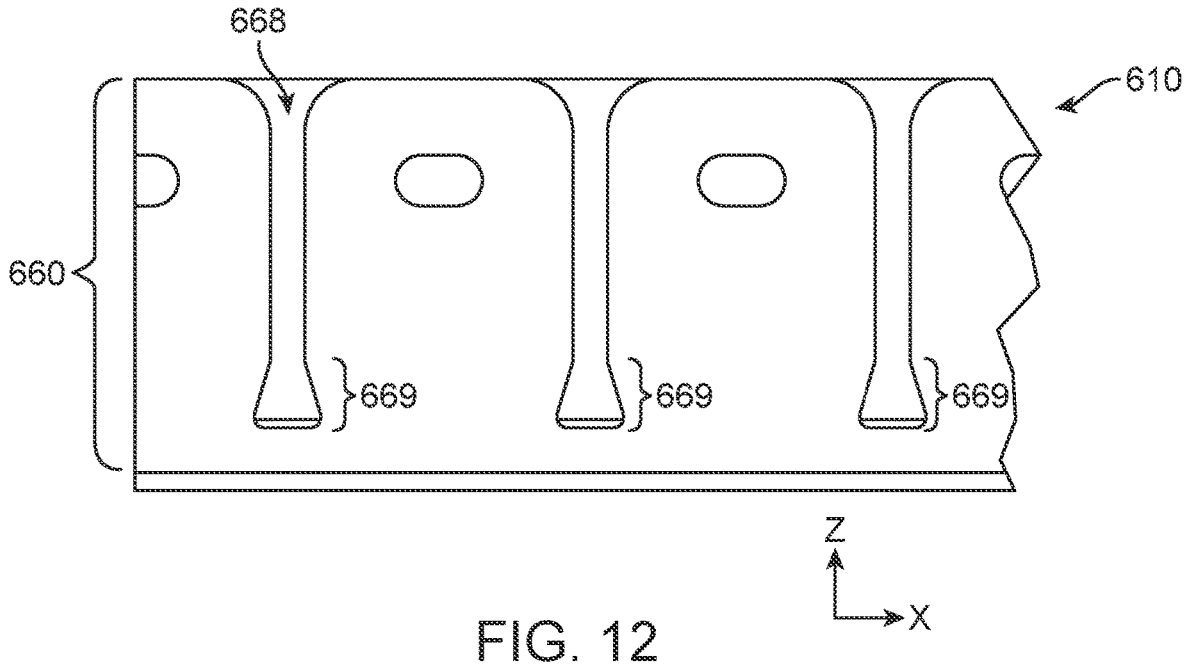
FIG. 12 is a side view of another alternative embodiment of a flexible drip cap as described herein.

Another illustrative embodiment of a flexible drip cap 610 is depicted in FIG. 12 to illustrate other optional features of one or more embodiments of a flange member used in flexible drip cap as described herein. Similar to other embodiments described herein, the flange member 660 may include a plurality of fins 666 separated from each other by slots 668. In one or more embodiments of flexible drip cap as described herein, the bottom of the slots 668 may be enlarged relative to the remainder of the slot 668 to potentially reduce stress concentration at the bottom of the slot 668 when the flexible drip cap 610 is bent around the y-axis to follow the shape of a fenestration unit frame as described herein. Reducing stress concentrations at the bottom of the slots 668 may reduce cracking or other failure modes that may be associated with slots that do not include stress relief features at their bottom ends.

Although one or more embodiments of flexible drip cap as described herein may include cap members having front edges with rounded profiles to improve water shedding properties of the flexible drip cap described herein, many other features may alternatively be used along the front edge of the cap members of flexible drip cap as described herein. Some alternative profiles for front edges of cap members used in flexible drip cap as described herein are depicted in FIGS. 13A-13C.

Figure 13A:
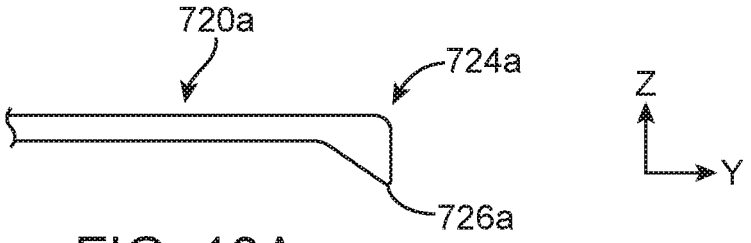
FIGS. 13A-13C depict alternative embodiments of the front edge of a cap member of a flexible drip cap as described herein.

For example, in FIG. 13A, cap member 720*a* includes a front edge 724*a* having a relatively sharp bottom edge 726*a* that limits the movement of water flowing down the front edge 724*a* towards the back edge (not shown) of cap member 720*a*.

Figure 13B:
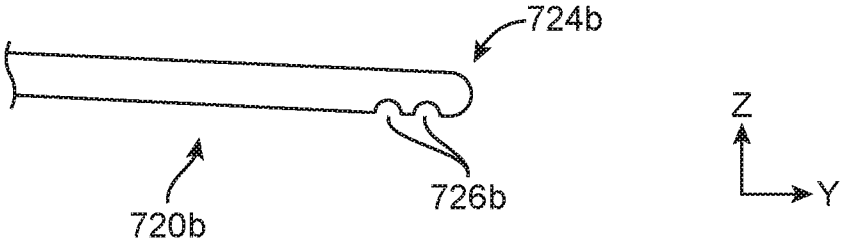

In FIG. 13B, cap member 720*b* includes a front edge 724*b* having one or more channels 726*b* formed in the underside of the cap member 720*b*. The edges of those channels 726*b* may preferably limit the movement of water flowing over the front edge 724*b* towards the back edge (not shown) of member 720*b*.

Figure 13C:
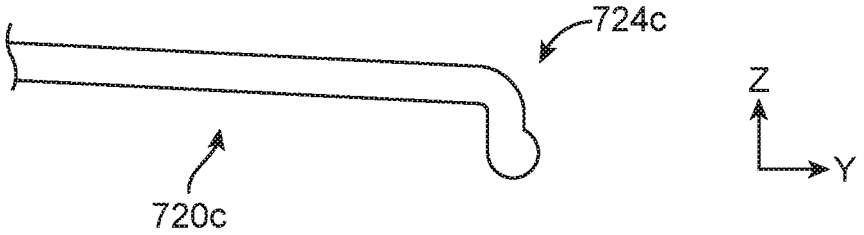

In FIG. 13C, member 720*c* includes a front edge 724*c* that includes a rounded profile located at the end of a vertical extension. That vertical extension and rounded profile preferably limit the movement of water flowing over the front edge 724*c* of the cap member 720*c* towards the back edge (not shown) of member 720*c*.

Figure 14:
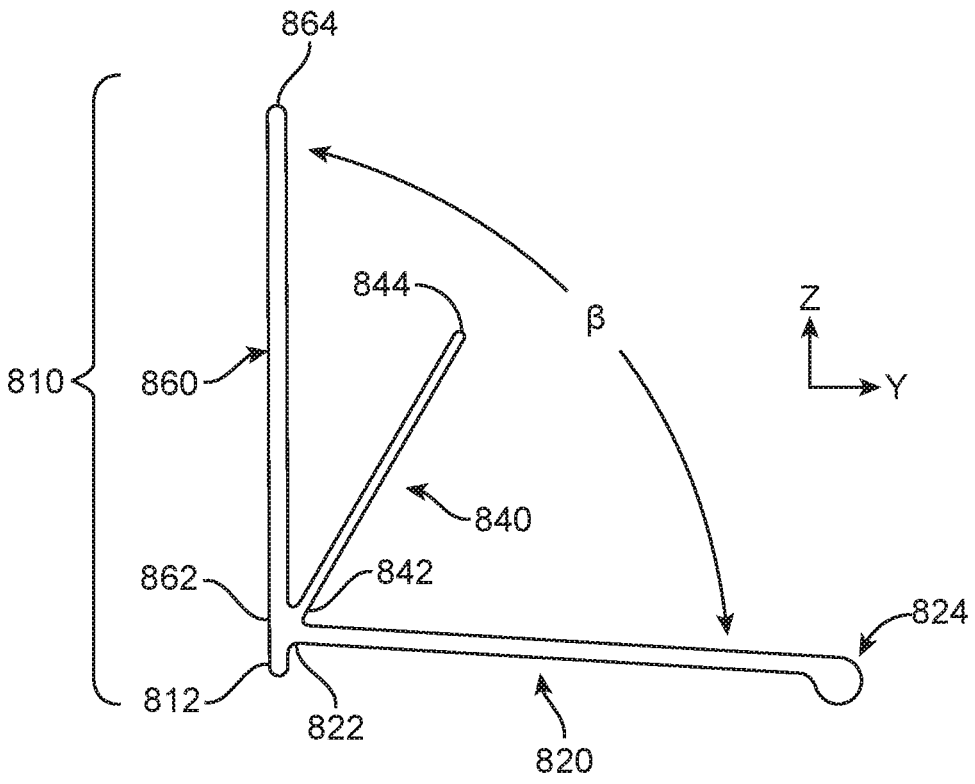
FIG. 14 is an end view of another illustrative embodiment of a flexible drip cap as described herein.

Some additional features that may be found in one or more embodiments of flexible drip cap as described herein can be described in connection with the illustrative embodiment of flexible drip cap 810 depicted in FIG. 14. Flexible drip cap 810 includes a cap member 820 having a back edge 822 and a front edge 824, a seal member 840 having an inner edge 842 and an outer edge 844, and a flange member 860 having a base edge 862 and a free edge 864.

One optional feature that may be found in one or more embodiments of flexible drip cap as described herein is seen in the relative widths of the seal member 840 relative to both the cap member 820 and the flange member 860. In particular, the width of the seal member 840 between its inner edge 842 and outer edge 844 is less than the width of the cap member 820 between its back edge 822 and its front edge 824, and also less than the width of the flange member 860 between its base edge 862 and its free edge 864.

Another optional feature that may be found in one or more embodiments of flexible drip cap as described herein is seen in the addition of a spine support 812 located along the spine of the flexible drip cap 810 as formed by the junction between the back edge 822 of cap member 820, inner edge 842 of seal member 840, and base edge 862 of flange member 860. The spine support 812 may raise the back at edge 822 of the cap member 820 relative to its front edge 824 which may, in one or more embodiments, improve water shedding properties of the cap member 820.

Yet another optional feature that may be found in one or more embodiments of flexible drip cap as described herein is seen in the angle β (beta) formed between the cap member 820 and the flange member 860. In the embodiment depicted in flexible drip cap 810, angle β (beta) is greater than 90° (as compared to other depicted illustrative embodiments of flexible drip cap as described herein wherein the same angle between the cap member and the flange member is typically substantially 90°.

The flexible drip cap described herein may be manufactured using any suitable manufacturing process or combination of processes. In one or more embodiments, the flexible drip cap may be manufactured through an extrusion process, with the various components being coextruded along the length of the flexible drip cap being produced. For those embodiments including a stiffener, surface treatments, tie layers, etc. may be used to enhance bonds between the stiffener and any surrounding polymeric materials used to manufacture the flexible drip cap described herein. Further, the embodiments that include stiffeners may be manufactured through a co-extrusion process, some potentially useful examples of which are described in, e.g., U.S. Pat. No. 4,151,031 (Goad et al.) and U.S. Pat. No. 6,047,514 (Verch).

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the flexible drip caps and related methods are discussed herein some possible variations have been described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. A flexible drip cap comprising:

a spine extending along a length of the flexible drip cap;

a cap member comprising a back edge and a front edge, wherein the back edge of the cap member extends along the spine of the flexible drip cap, and wherein the front edge of the cap member is spaced away from the back edge and the spine along the length of the flexible drip cap;

a flange member comprising a base edge and free edge, wherein the base edge of the flange member extends along the spine of the flexible drip cap, and wherein the free edge of the flange member is spaced away from the base edge and the spine along the length of the flexible drip cap; and a seal member comprising an inner edge and an outer edge, wherein the inner edge of the seal member extends along the spine of the flexible drip cap, and wherein the outer edge of the seal member is spaced away from the inner edge and the spine along the length of the flexible drip cap;

wherein the back edge of the cap member and the base edge of the flange member are attached to each other proximate the spine of the flexible drip cap such that the cap member and the flange member define an inside corner of the flexible drip cap when the cap member and the flange member are positioned such that the seal member is located within an arc of less than 180 degrees centered along the spine and extending from the cap member to the flange member.

2. A flexible drip cap according to claim 1, wherein the back edge of the cap member and the base edge of the flange member are attached to each other along a junction, and wherein the spine of the flexible drip cap comprises the junction of the back edge and the base edge.

3. A flexible drip cap according to claim 1, wherein the back edge of the cap member, the base edge of the flange member, and the inner edge of the seal member are attached to each other along a junction, and wherein the spine of the flexible drip cap comprises the junction of the back edge, the base edge, and the inner edge.

4. A flexible drip cap according to claim 1, wherein the cap member comprises an inside surface facing the seal member and an outside surface facing away from the seal member, wherein the inside surface and the outside surface extend between the back edge and the front edge of the cap member along the length of the flexible drip cap, and wherein the front edge comprises a drip edge comprising a rounded profile in a cross-section taken transverse to the spine.

5. A flexible drip cap according to claim 4, wherein, in any selected cross-section taken transverse to the spine along a majority of the length of the flexible drip cap, the rounded profile defines a radius of curvature equal to or greater than a thickness of the cap member measured between the inside surface and the outside surface at any location between the inner edge of the seal member and the rounded profile of the drip edge.

6. A flexible drip cap according to claim 1, wherein the cap member comprises an inside surface facing the seal member and an outside surface facing away from the seal member, wherein the inside surface and the outside surface extend between the back edge and the front edge of the cap member along the length of the flexible drip cap, and wherein, in any selected cross-section taken transverse to the spine along a majority of the length of the flexible drip cap, the cap member comprises a cap member thickness measured transverse to the inside surface and the outside surface, and wherein the cap member thickness is greater proximate the front edge than proximate a midpoint between the back edge and the front edge of the cap member.

7. A flexible drip cap according to claim 1, wherein the cap member comprises a stiffener located between back edge and the front edge of the cap member, wherein the stiffener is at least partially encapsulated in a covering polymeric material forming the back edge and the front edge of the cap member, and wherein the stiffener comprises a rear edge and a forward edge, wherein the rear edge is located between the forward edge and the back edge of the cap member, and wherein the forward edge is located between rear edge and the front edge of the cap member.

8. A flexible drip cap according to claim 7, wherein the rear edge of the stiffener is spaced apart from the back edge of the cap member, and wherein the forward edge of the stiffener is spaced apart from the front edge of the cap member.

9. A flexible drip cap according to claim 7, wherein the stiffener comprises a stiffener width measured transverse to the spine between the rear edge and the forward edge of the stiffener, and wherein the stiffener width is less than a cap member width measured transverse to the spine between the back edge and the front edge of the cap member.

10. A flexible drip cap according to claim 7, wherein the stiffener comprises a bending modulus about an axis aligned with the spine that is greater than a bending modulus of an equivalent body constructed of the polymeric material at least partially encapsulating the stiffener.

11. A flexible drip cap according to claim 7, wherein the stiffener comprises a metallic stiffener.

12. A flexible drip cap according to claim 7, wherein the flange member is constructed of the polymeric material at least partially encapsulating the stiffener in the cap member.

13. A flexible drip cap according to claim 12, wherein the seal member is constructed of a second polymeric material.

14. A flexible drip cap according to claim 1, wherein the flange member comprises a plurality of fins, wherein each pair of adjacent fins is separated from each other by a slot extending towards the base edge of the flange member from the free edge of the flange member.

15. A flexible drip cap according to claim 1, wherein the flange member and the seal member are attached to each other proximate the free edge of the flange member and the outer edge of the seal member.

16. A flexible drip cap according to claim 15, wherein at least a portion of the flange member is not attached to the seal member between the base edge of the flange member and the free edge of the flange member.

17. A flexible drip cap comprising:

a spine extending along a length of the flexible drip cap;

a cap member comprising a back edge and a front edge, wherein the back edge of the cap member extends along the spine of the flexible drip cap, and wherein the front edge of the cap member is spaced away from the back edge and the spine along the length of the flexible drip cap;

a flange member comprising a base edge and free edge, wherein the base edge of the flange member extends along the spine of the flexible drip cap, and wherein the free edge of the flange member is spaced away from the base edge and the spine along the length of the flexible drip cap, wherein the flange member comprises a plurality of fins, wherein each pair of adjacent fins is separated from each other by a slot extending towards the base edge of the flange member from the free edge of the flange member; and a seal member comprising an inner edge and an outer edge, wherein the inner edge of the seal member extends along the spine of the flexible drip cap, and wherein the outer edge of the seal member is spaced away from the inner edge and the spine along the length of the flexible drip cap;

wherein the spine of the flexible drip cap is formed by a junction between the back edge of the cap member and the base edge of the flange member;

wherein the seal member extends away from the junction between the back edge of the cap member and the base edge of the flange member such that the seal member is located within an inside corner defined by the cap member and the flange member;

wherein the cap member comprises an inside surface facing the seal member and an outside surface facing away from the seal member, wherein the inside surface and the outside surface extend between the back edge and the front edge of the cap member along the length of the flexible drip cap, and wherein the front edge comprises a drip edge comprising a rounded profile in a cross-section taken transverse to the spine;

wherein the cap member comprises a stiffener located between back edge and the front edge of the cap member, wherein the stiffener is at least partially encapsulated in a covering polymeric material forming the back edge and the front edge of the cap member, and wherein the stiffener comprises a rear edge and a forward edge, wherein the rear edge is located between the forward edge and the back edge of the cap member, and wherein the forward edge is located between rear edge and the front edge of the cap member.

18. A flexible drip cap according to claim 17, wherein, in any selected cross-section taken transverse to the spine along a majority of the length of the flexible drip cap, the rounded profile defines a radius of curvature equal to or greater than a thickness of the cap member measured between the inside surface and the outside surface at any location between the inner edge of the seal member and the rounded profile of the drip edge.

19. A flexible drip cap according to claim 17, wherein the rear edge of the stiffener is spaced apart from the back edge of the cap member, and wherein the forward edge of the stiffener is spaced apart from the front edge of the cap member.

20. A flexible drip cap according to claim 17, wherein the stiffener comprises a bending modulus about an axis aligned with the spine that is greater than a bending modulus of an equivalent body constructed of the polymeric material at least partially encapsulating the stiffener.

21. A flexible drip cap according to claim 17, wherein the flange member and the seal member are attached to each other proximate the free edge of the flange member and the outer edge of the seal member.

22. A flexible drip cap according to claim 21, wherein at least a portion of the flange member is not attached to the seal member between the base edge of the flange member and the free edge of the flange member.

23. A method of installing flexible drip cap on a fenestration unit wherein the flexible drip cap includes a cap member, a flange member, and a seal member, wherein a back edge of the cap member, a base edge of the flange member, and an inner edge of the seal member are attached to each other proximate a spine of the flexible drip cap, and wherein the seal member is located between the cap member and the flange member when the cap member and the flange member are positioned such that the seal member is located within an arc of less than 180 degrees centered along the spine and extending from the cap member to the flange member, the method comprising:

deforming the cap member of the flexible drip cap such that the spine and the cap member of the flexible drip cap follow a curved path matching the shape of a top edge of a fenestration unit installed in a building opening; and attaching the cap member to the top edge of the fenestration unit such that the cap member is positioned on the top edge of the fenestration unit with the flange member and the seal member both positioned on and aligned with the building wall.

24. A method according to claim 23, wherein the cap member comprises an inside surface facing the seal member and an outside surface facing away from the seal member, wherein the inside surface and the outside surface extend between the back edge and a front edge of the cap member along the length of the flexible drip cap, and wherein, in any selected cross-section taken transverse to the spine along a majority of the length of the flexible drip cap, the cap member comprises a cap member thickness measured transverse to the inside surface and the outside surface, and wherein the cap member thickness is greater proximate the front edge than proximate a midpoint between the back edge and the front edge of the cap member.

25. A method according to claim 23, wherein the cap member comprises a stiffener located between back edge and a front edge of the cap member, wherein the stiffener is at least partially encapsulated in a covering polymeric material forming the back edge and the front edge of the cap member, and wherein the stiffener comprises a rear edge and a forward edge, wherein the rear edge is located between the forward edge and the back edge of the cap member, and wherein the forward edge is located between rear edge and the front edge of the cap member.

* * * * *